US008294441B2

(12) United States Patent
Gurcan et al.

(10) Patent No.: US 8,294,441 B2
(45) Date of Patent: Oct. 23, 2012

(54) FAST LOW DROPOUT VOLTAGE REGULATOR CIRCUIT

(75) Inventors: Hakan Ates Gurcan, Los Gatos, CA (US); Murat Mehmet Okyar, San Jose, CA (US)

(73) Assignee: Decicon, Inc., Santa Clara, CA (US)

( * ) Notice: Subject to any disclaimer, the term of this patent is extended or adjusted under 35 U.S.C. 154(b) by 573 days.

(21) Appl. No.: 11/939,377

(22) Filed: Nov. 13, 2007

(65) Prior Publication Data

US 2008/0174289 A1 Jul. 24, 2008

Related U.S. Application Data

(60) Provisional application No. 60/865,628, filed on Nov. 13, 2006.

(51) Int. Cl.
*G05F 1/575* (2006.01)

(52) U.S. Cl. ..... 323/280

(58) Field of Classification Search ..... 323/241, 323/280–283, 271
See application file for complete search history.

(56) References Cited

U.S. PATENT DOCUMENTS 2,220,099 A * 11/1940 Guenther et al. ..... 562/93
3,020,099 A * 2/1962 Smith ..... 384/191.2
3,541,446 A * 11/1970 Prozeller ..... 324/99 D
4,473,744 A * 9/1984 Mizokami ..... 250/214 P
6,046,577 A * 4/2000 Rincon-Mora et al. ..... 323/282
6,160,325 A * 12/2000 Turvey ..... 307/125
6,201,375 B1 * 3/2001 Larson et al. ..... 323/277
6,246,221 B1 * 6/2001 Xi ..... 323/280
6,246,222 B1 * 6/2001 Nilles et al. ..... 323/283
6,373,297 B1 * 4/2002 Lee et al. ..... 327/108
6,388,433 B2 * 5/2002 Marty ..... 323/284
6,437,638 B1 * 8/2002 Coles et al. ..... 327/540
6,465,994 B1 * 10/2002 Xi ..... 323/274
6,674,274 B2 * 1/2004 Hobrecht et al. ..... 323/285
6,677,735 B2 * 1/2004 Xi ..... 323/273
6,696,882 B1 * 2/2004 Markowski et al. ..... 327/531
6,703,815 B2 * 3/2004 Biagi ..... 323/280
6,839,252 B2 * 1/2005 Tai et al. ..... 363/65
6,856,124 B2 * 2/2005 Dearn et al. ..... 323/280

(Continued)

OTHER PUBLICATIONS

U.S. Appl. No. 12/729,142, filed Mar. 22, 2010, Gurcan.

(Continued)

*Primary Examiner* — Adolf Berhane
*Assistant Examiner* — Yemane Mehari
(74) *Attorney, Agent, or Firm* — Kilpatrick Townsend & Stockton LLP

(57) ABSTRACT

A voltage regulator includes first and second closed-loop amplifiers and a N-type transistor. The first amplifier receives a first reference voltage and a feedback voltage. The second amplifier is responsive to the first amplifier and to the regulated output voltage of the regulator. Both amplifiers are biased by a biasing voltage. The second amplifier has a bandwidth greater than the bandwidth of the first amplifier and a gain smaller that the gain of the first amplifier. The N-type transistor has a first terminal responsive to the output of the second amplifier, a second terminal that receives the input voltage being regulated, and a third terminal that supplies the regulated output voltage. The feedback voltage is generating by dividing the regulated output voltage. An optional fixed or dynamically biased current source biases the first terminal of the N-type transistor. The voltage regulator optionally includes an overshoot correction circuit.

4 Claims, 10 Drawing Sheets

U.S. PATENT DOCUMENTS

| | | | | |
|---|---|---|---|---|
| 6,933,772 | B1 * | 8/2005 | Banerjee et al. | 327/541 |
| 6,977,489 | B2 * | 12/2005 | Isham | 323/272 |
| 6,989,659 | B2 * | 1/2006 | Menegoli et al. | 323/274 |
| 7,009,348 | B2 * | 3/2006 | Mogilner et al. | 315/307 |
| 7,102,394 | B1 * | 9/2006 | Wilson et al. | 327/54 |
| 7,109,691 | B2 * | 9/2006 | Brooks et al. | 323/282 |
| 7,141,956 | B2 | 11/2006 | Chapuis | |
| 7,167,054 | B1 * | 1/2007 | Dening et al. | 330/297 |
| 7,170,352 | B1 * | 1/2007 | Caldwell | 330/261 |
| 7,262,658 | B2 * | 8/2007 | Ramaswamy et al. | 330/251 |
| 7,274,182 | B2 | 9/2007 | Huang | |
| 7,304,464 | B2 * | 12/2007 | Weng et al. | 323/285 |
| 7,315,153 | B2 | 1/2008 | Tazawa et al. | |
| 7,327,127 | B2 * | 2/2008 | Ho | 323/271 |
| 7,333,348 | B2 * | 2/2008 | Horiuchi et al. | 363/16 |
| 7,342,392 | B2 * | 3/2008 | Liao | 323/282 |
| 7,348,840 | B2 * | 3/2008 | Magrath et al. | 330/10 |
| 7,358,706 | B2 | 4/2008 | Lys | |
| 7,378,827 | B2 | 5/2008 | Stoichita | |
| 7,394,236 | B2 | 7/2008 | Chapuis | |
| 7,397,226 | B1 * | 7/2008 | Mannama et al. | 323/273 |
| 7,414,471 | B2 * | 8/2008 | Krishnan et al. | 330/251 |
| 7,486,058 | B2 * | 2/2009 | Szepesi | 323/272 |
| 7,501,801 | B2 * | 3/2009 | Brown et al. | 323/224 |
| 7,531,996 | B2 * | 5/2009 | Yang et al. | 323/282 |
| 2006/0198165 | A1 | 9/2006 | O'Driscoll et al. | |
| 2007/0114985 | A1 * | 5/2007 | Latham et al. | 323/283 |
| 2008/0150368 | A1 * | 6/2008 | Gurcan | 307/82 |
| 2008/0150500 | A1 * | 6/2008 | Gurcan | 323/271 |
| 2008/0157740 | A1 * | 7/2008 | Gurcan | 323/283 |
| 2008/0278230 | A1 | 11/2008 | Kost et al. | |
| 2009/0015066 | A1 * | 1/2009 | Guo et al. | 307/31 |
| 2009/0015218 | A1 | 1/2009 | O'Driscoll et al. | |

OTHER PUBLICATIONS

Austria Micro Systems—Liberty: Power Management IP Library from Mobile Applications—Analog LDO—Low Power, Low Noise, Low Dropout, 150mA Voltage Regulator, Feb. 2002, pp. 1-4.

Linear Technology—LTC3025 300mA Micropower VLDO Linear Regulator, Data Sheet, Copyright 2004, pp. 1-12, Linear Technology Corp.

Requirement for Restriction/Election for U.S. Appl. No. 11/957,357, mailed on Oct. 30, 2009, 9 pages.

Non-Final Office Action for U.S. Appl. No. 11/957,357, mailed on Mar. 25, 2010, 7 pages.

Non-Final Office Action for U.S. Appl. No. 11/957,305, mailed on Nov. 13, 2009, 10 pages.

Non-Final Office Action for U.S. Appl. No. 11/956,070, mailed on Sep. 22, 2009, 9 pages.

Final Office Action for U.S. Appl. No. 11/957,357, mailed on Oct. 27, 2010, 11 pages.

Final Office Action for U.S. Appl. No. 11/957,305, mailed on Aug. 23, 2010, 17 pages.

Non-Final Office Action for U.S. Appl. No. 12/729,142, mailed on Jan. 25, 2011, 16 pages.

Notice of Allowance for U.S. Appl. No. 11/957,305, mailed on Feb. 11, 2011.

Notice of Allowance for U.S. Appl. No. 12/729,142, mailed on Jun. 27, 2011, 8 pages.

Non-Final Office Action for U.S. Appl. No. 11/957,357, mailed on Jul. 15, 2011, 8 pages.

Final Office Action for U.S. Appl. No. 11/957,357, mailed on Jan. 31, 2012, 15 pages.

* cited by examiner

FAST LOW DROPOUT VOLTAGE REGULATOR CIRCUIT

CROSS-REFERENCES TO RELATED APPLICATIONS

The present application claims benefit under 35 USC 119 (e) of U.S. provisional Application No. 60/865,628, filed Nov. 13, 2006, entitled "Fast Low Dropout Voltage Regulator Circuit," the content of which is incorporated herein by reference in its entirety.

BACKGROUND OF THE INVENTION

Low Drop-Out (LDO) linear voltage regulator integrated circuits are widely used in electronic systems, particularly in applications which require power supplies with low noise and low ripple. In portable applications, LDO regulators supply power to the analog baseband stages, radio frequency stages and to other noise-sensitive analog circuit blocks.

The efficiency and the physical size of the power supply solution are two important aspects in portable applications where the amount of energy stored in the battery is limited and board space is at a premium. The efficiency loss of an LDO regulator has two principal components, namely thermal dissipation, and ground current.

FIG. 1 is a block diagram of an LDO regulator 10, as known in the prior art. LDO regulator 10 includes a pair of closed-loop amplifiers 12 and 14, and a PMOS pass transistor 16. Thermal dissipation is determined by the difference between the input and output voltages of the LDO regulator 10, and the current through PMOS transistor 16 which nearly equals the load current. When the difference between the input and the output voltages is large and high currents are delivered to the load, a large amount of power is dissipated by transistor 16. Minimizing the input-output voltage differential minimizes the energy so wasted for a given load current. Thus it is advantageous to operate the LDO regulators at a low input-output voltage differential. Minimizing the input-output voltage differential would require lowering of the supply voltage of the internal circuitry in LDO regulator 10 to a level close to the regulated output voltage, which in turn, poses a significant design challenge as lower output voltages are demanded from the output of the LDO regulator 10.

The ground current of an LDO regulator mostly includes bias currents for biasing of internal circuitry and for generating reference voltages and currents. The ground current does not contribute to the load current as it flows from the input supply to ground, through internal circuitry. Although at low load currents, stable LDO regulator operation can be achieved using relatively low bias currents, high load currents usually require high bias currents to ensure stable operation while ensuring good transient response. Conventional LDO regulators, such as that shown in FIG. 1, employ a constant biasing scheme with high internal bias currents to provide a stable operation at high load currents. Such a biasing scheme wastes valuable current at light loads and the light load efficiency suffers as a result. Another conventional approach is to keep the bias currents constant at a low to moderate level, but such an approach deteriorates the transient response of the LDO regulator.

BRIEF SUMMARY OF THE INVENTION

In accordance with one embodiment of the present invention, a voltage regulator circuit includes, in part, first and second closed-loop amplifiers and a N-type transistor. The first amplifier is adapted to receive a first reference voltage and a feedback voltage and is biased by a first biasing voltage. The second amplifier is responsive to the output of the first amplifier and to the regulated output voltage supplied by the regulator circuit. The second amplifier is also biased by the first biasing voltage and has a bandwidth that is greater than the bandwidth of the first amplifier and a gain that is smaller that the gain of the first amplifier. The N-type transistor has a first terminal responsive to the output of the second amplifier, a second terminal that receives the input voltage being regulated, and a third terminal that supplies the regulated output voltage. The feedback voltage is generating by dividing the regulated output voltage.

In one embodiment, the N-type transistor is an N-type MOS transistor. In another embodiment, the N-type transistor is a bipolar NPN transistor. In one embodiment, a current source supplies a substantially fixed current to the first terminal of the N-type transistor. In another embodiment, the current supplied to the first terminal of the N-type transistor is proportional to a current flowing through the second terminal of the N-type transistor. In one embodiment, the current source includes a current mirror responsive to the first biasing voltage, and a second N-type transistor that is responsive to the output of the second amplifier and to the current mirror.

In one embodiment, the voltage regulator circuit includes a comparator, and an NMOS transistor. The comparator is responsive to the output of the first amplifier and to the regulated output voltage. The NMOS transistor is responsive to the output of the comparator. The NMOS transistor has a source terminal that is coupled to a ground terminal and a drain terminal coupled to a first terminal of a resistor which has a second terminal adapted to receive the regulated output voltage. In one embodiment, an offset voltage is applied between the second amplifier and the comparator.

A method of regulating a voltage, in accordance with one embodiment of the present invention includes, in part, applying a first reference voltage and a feedback voltage to a first amplifier, applying an output signal of the first amplifier and a regulated output voltage to a second amplifier, biasing the first and second amplifiers using a first biasing voltage, and applying an output of the second amplifier to a first terminal of an N-type transistor. The N-type transistor has a second terminal receiving an input voltage being regulated, and a third terminal supplying the regulated output voltage. The second amplifier has a bandwidth that is greater than a bandwidth of the first amplifier and a gain that is smaller that a gain of the first amplifier. The feedback voltage is generated from the regulated output voltage.

In one embodiment, the N-type transistor is an N-type MOS transistor. In another embodiment, the N-type transistor is a bipolar NPN transistor. In one embodiment, a current source supplies a substantially fixed current to the first terminal of the N-type transistor. In another embodiment, the current supplied to the first terminal of the N-type transistor is proportional to a current flowing through the second terminal of the N-type transistor. In one embodiment, the current source includes a current mirror responsive to the first biasing voltage, and a second N-type transistor that is responsive to the output of the second amplifier and to the current mirror.

In one embodiment, the method further includes, in part, comparing an output voltage of the first amplifier to the regulated output voltage, and providing a discharge path from the third terminal of the first N-type transistor to a ground terminal when the output voltage of the first amplifier is detected as being smaller than the regulated output voltage. In accordance with one embodiment, an offset voltage is applied between the second amplifier and the comparator.

DETAILED DESCRIPTION OF THE INVENTION

Figure 1:
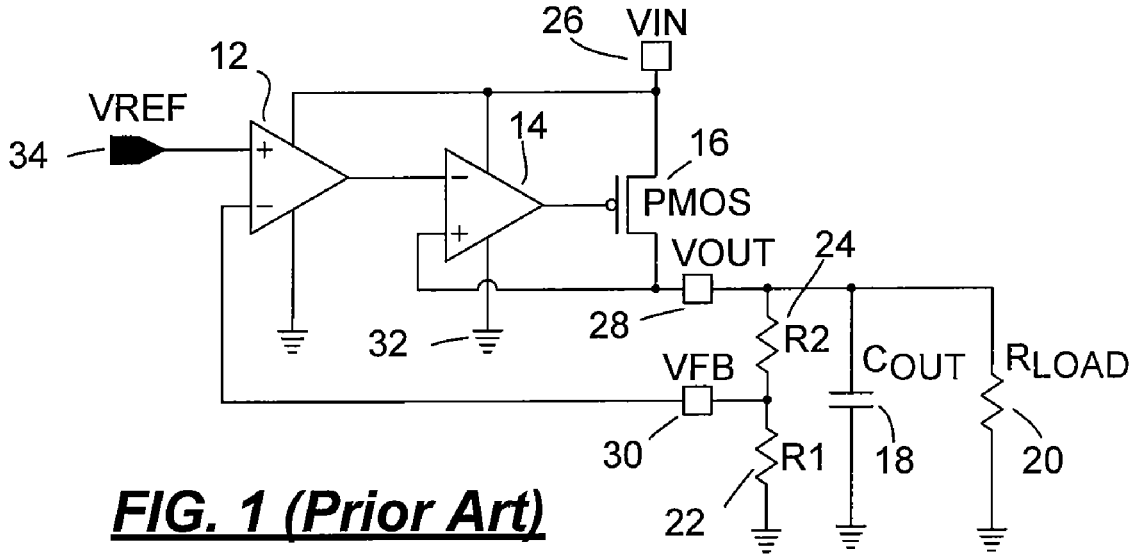
FIG. 1 (Prior Art)
FIG. 1 is a block diagram of a low drop-out (LDO) voltage regulator, as known in the prior art.
Figure 2:
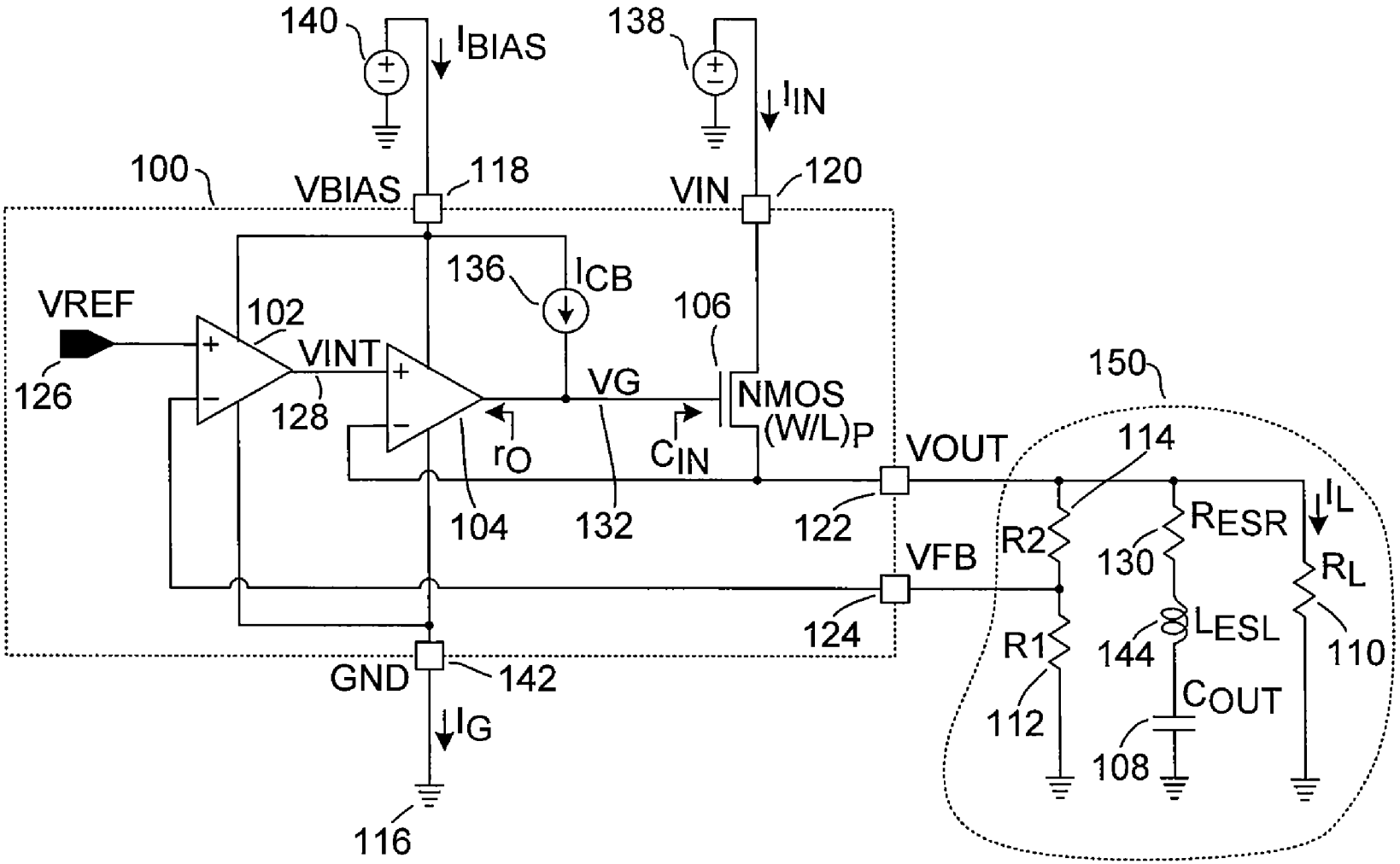
FIG. 2 is a block diagram of an LDO voltage regulator, in accordance with one embodiment of the present invention.

FIG. 2 is a block diagram of a low drop-out (LDO) linear integrated circuit 100, in accordance with one embodiment of the present invention. LDO 100 is shown as including amplifiers 102, 104, N-type pass element 106, and current source 136. Amplifiers 102 and 104 form a dual-feedback loop control circuit adapted to regulate output voltage VOUT delivered to output node 122. The following description is provided with reference to an NMOS transistor 106. It is understood that any N-type transistor, such as a bipolar NPN transistor, may also be used.

Amplifier 102 is a high-gain low-bandwidth amplifier (HGLBA) forming a relatively slower feedback loop (SFL) adapted to control the DC accuracy of regulator 100. Amplifier 104 is a low-gain, high-bandwidth amplifier (LGHBA) that together with NMOS transistor 106 form a fast and high current unity gain voltage follower. Amplifier 104 forms a fast feedback loop (FFL) adapted to maintain output voltage VOUT within a predefined range in response to a fast load transient. Current source 136 ($I_{CB}$) supplies a constant bias current to node 132 (VG) and is used to define the output resistance $r_O$ of amplifier 104.

Input terminal 118 is used to supply biasing voltage VBIAS to LDO regulator 100. Input voltage VIN regulated by LDO regulator 100 is applied to input terminal 120. Reference voltage VREF applied to amplifier 102 is received by input terminal 126 but may be internally generated using any one of a number of conventional design techniques. Because in accordance with the present invention biasing voltage VBIAS is separate from input voltage VIN, input voltage VIN may be lowered to a value that is above output voltage to increase efficiency, while keeping VBIAS at a sufficiently high level for biasing the internal circuitry.

Components collectively identified using reference numeral 150 are externally supplied to ensure proper operation of LDO regulator 100. Resistors 114 and 112 divide the output voltage VOUT—delivered to output terminal 122—to generate a feedback voltage VFB that is supplied to amplifier 102 via input terminal 124. Accordingly, voltage VOUT is nominally defined by the following expression:

$$VOUT=VREF*(R1+R2)/R1 \quad (1)$$

where R1 and R2 are the resistances of resistors 112 and 114, respectively.

Resistor 110, having the resistance $R_L$, represents the load seen by LDO regulator 100. Output capacitor 108, having the capacitance $C_{OUT}$, is used to maintain loop stability and to keep output voltage VOUT relatively constant during load transients. Capacitance $C_{OUT}$ is typically selected to have a relatively large value to keep output voltage VOUT within a predefined range while the dual-feedback loops respond and regain control in response to a load transient. Resistor 130 represents the inherent equivalent series resistance (ESR) of output capacitor 108. The resistance $R_{ESR}$ of resistor 130 is defined by the construction and material of capacitor 108. Inductor 144 represents the inherent equivalent series inductance (ESL) of output capacitor 108. The inductance of inductor 144 is defined by the construction and material of the capacitor 108. In voltage regulator applications where fast transient response is important, capacitor 108 is typically a ceramic chip capacitor which is characterized by low ESR and ESL values compared to its tantalum and aluminum electrolytic counterparts. For a typical 1 μF 10V ceramic chip capacitor 108, representative values for the ESR and ESL are $R_{ESR}$=10 mΩ, $L_{ESL}$=1 nH.

Figure 3A:
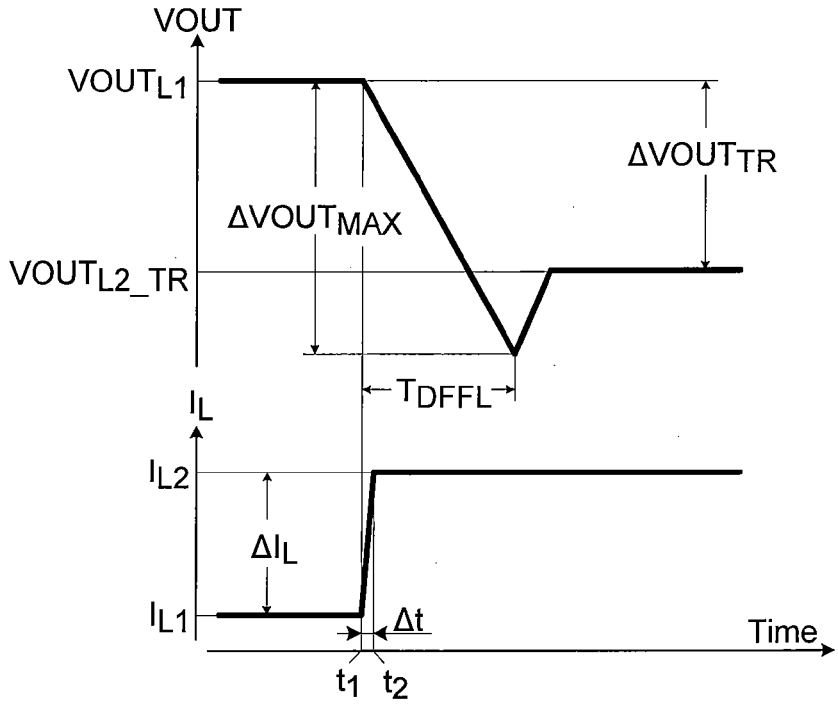
FIG. 3A illustrates the short-term transient response of the output voltage of the LDO regulator of FIG. 2.

Referring to FIGS. 2 and 3A concurrently, assume the load current $I_L$ changes from a low level $I_{L1}$ to a higher level $I_{L2}$ in a time interval Δt that is small compared to the response time $T_{DFFL}$ of the FFL and that the current through resistor 114 is negligible compared to currents of $I_{L1}$ or $I_{L2}$. Also assume that the voltage VINT applied to the input terminal of amplifier 104 remains relatively constant within time intervals close to $T_{DFFL}$. These are valid assumptions since the response time $T_{DSFL}$ of the SFL is much larger than $T_{DFFL}$. The output load transient event is illustrated in FIG. 3A.

When a large load current transient is applied to the output, it causes on the output voltage (i) a voltage spike induced by the ESL, (ii) an offset voltage induced by the ESR and (iii) a voltage droop caused by the loop response time. The effects of $L_{ESL}$ and $R_{ESR}$ can be kept relatively small by proper selection of external components and by following proper layout techniques. As an example, a load current step of 0 to 100 mA in 100 ns would cause a peak output voltage deviation of 1 mV due to 1 nH of ESL. The contribution of ESR to the transient output voltage deviation is also relatively small. As an example, a load current step of 0 to 100 mA would cause a peak output voltage deviation of 1 mV due to 10 mΩ of ESR. The voltage droop is caused by the non-zero loop response time $T_{DFFL}$. Assuming that $\Delta I_L$ is the difference between $I_{L2}$ and $I_{L1}$, the following approximation can be written about the droop rate:

$$d(VOUT)/dt=\Delta I_L/C_{OUT} \quad (2)$$

During the period $T_{DFFL}$, the load current is supplied by $C_{OUT}$. At the end of $T_{DFFL}$, the maximum output voltage deviation from the initial regulation value of $VOUT_{L1}$ may be written as:

$$\Delta VOUT_{MAX}=\Delta I_L*T_{DFFL}/C_{OUT} \quad (3)$$

After the expiration of $T_{DFFL}$, the FFL brings the output voltage to $VOUT_{L2_TR}$, as shown by the following expression.

$$\Delta VOUT_{TR}=VOUT_{L1}-VOUT_{L2_TR}\approx\Delta V_{GS}/A_{LGHBA} \quad (4)$$

In expression (4), $A_{LGHBA}$ represents the voltage gain of the amplifier 104, $\Delta V_{GS}$ is the voltage difference between the gate-to-source voltages $V_{GS2}$ and $V_{GS1}$ of NMOS 106 at drain current levels of $I_{L2}$ and $I_{L1}$ respectively, and $\Delta VOUT_{TR}$ represents the transient load regulation characteristic of the LDO regulator 100.

Figure 3B:
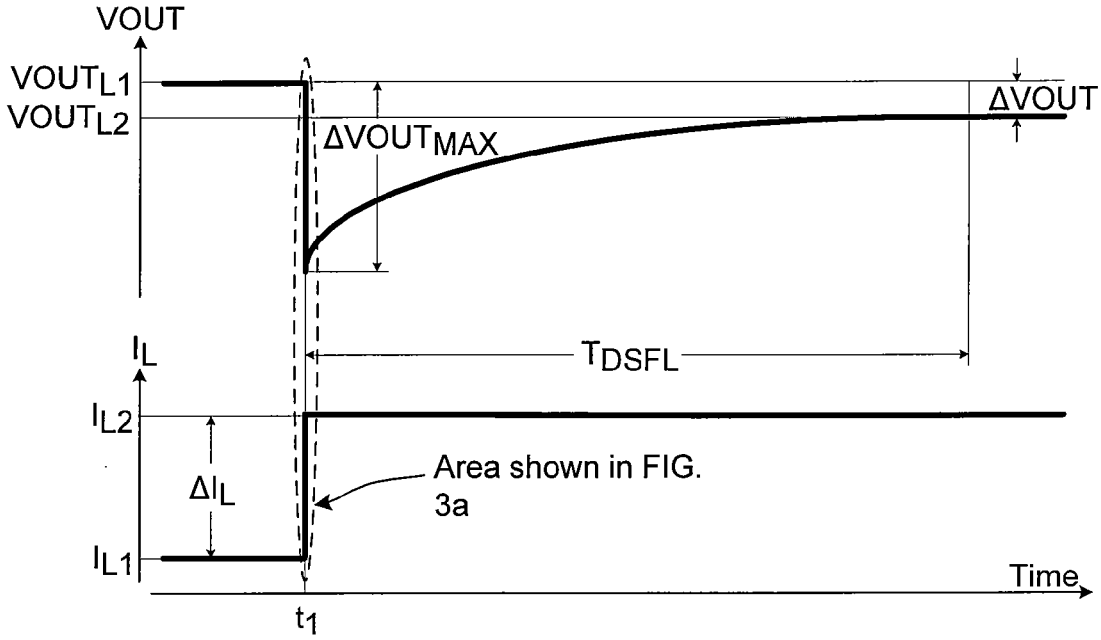
FIG. 3B illustrates the long-term transient response of the output voltage of the LDO regulator of FIG. 2.

The following are exemplary numerical values of a few parameters associated with LDO regulator 100 of FIG. 2. This example shows that the FFL catches the output voltage at a voltage level 30 mV lower than the no-load output voltage in response to a fast-load transient:

$I_{L1}$=0
$I_{L2}$=100 mA
$A_{LGHBA}$=20
$T_{DFFL}$=300 ns
$C_{OUT}$=1 μF
$V_{GS_L1}$=500 mV (at $I_{L1}$=0)
$V_{GS_L2}$=900 mV (at $I_{L2}$=100 mA)
d(VOUT)/dt=ΔIL/$C_{OUT}$=100 mV/μs
$\Delta VOUT_{MAX}=\Delta I_L*T_{DFFL}/C_{OUT}$=30 mV
$\Delta VOUT_{TR}=\Delta V_{GS}/A_{LGHBA}$=20 mV After the initial events described above, amplifier 102 which has a response time of $T_{DSFL}$ brings the output voltage back to DC regulation as shown in FIG. 3B. The output voltage is brought back to within ΔVOUT of $VOUT_{L1}$ after the time period $T_{DSFL}$ by amplifier 102. Voltage difference ΔVOUT which characterizes the DC load regulation characteristic of the LDO regulator 100 is defined below:

$$\Delta VOUT=\Delta V_{GS}/(A_{LGHBA}*A_{HGLBA})*(R1+R2)/R1 \quad (5)$$

where $A_{HGLBA}$ is the voltage DC gain of amplifier 102.

The following are exemplary numerical values of a few parameters associated with LDO regulator 100 of FIG. 2:

R1=R2=100 k Ω
$A_{LGHBA}$=20
$A_{HGLBA}$=400
$V_{GS_L1}$=500 mV (at $I_{L1}$=0)
$V_{GS_L2}$=900 mV (at $I_{L2}$=100 MA)
ΔVOUT=0.1 mV

As described above, the DC and transient performances of LDO regulator 100 are handled by two separate amplifiers used in a dual-feedback loop arrangement, thus enabling each loop's performance to be independently optimized. This, in turn, enables LDO regulator 100 to be relatively very fast and highly accurate.

Figure 4:
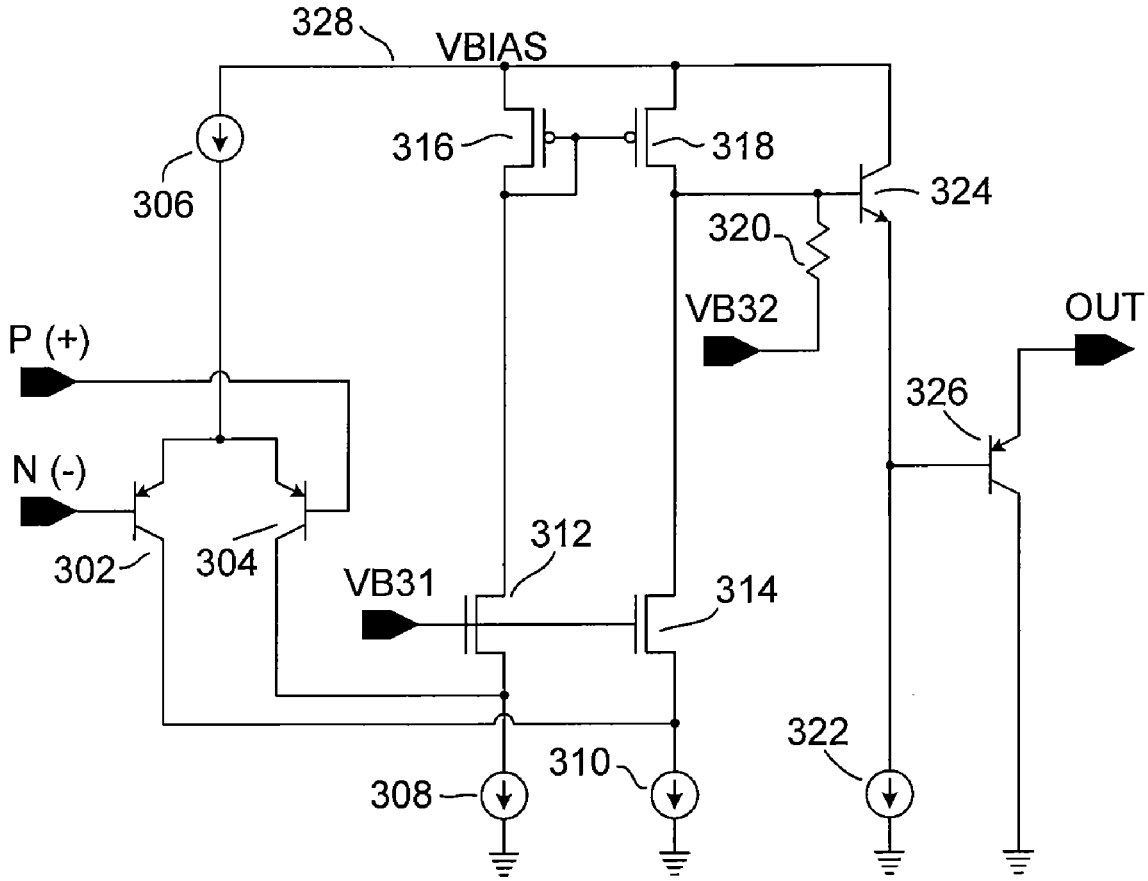
FIG. 4 is a schematic diagram of an exemplary low-gain high-bandwidth amplifier disposed in the LDO voltage regulator of FIG. 2, in accordance with one embodiment of the present invention.

FIG. 4 is a transistor schematic diagram of amplifier 104 of FIG. 2, according to one embodiment of the invention. As seen from FIG. 4, amplifier 104 is shown as including a folded cascode amplification stage buffered by a voltage follower output stage. Bias voltages VB31 and VB32 may be generated using any one of a number of conventional design techniques. In one embodiment, bias voltage VB32 is connected to the output node of the LDO regulator (not shown). PNP transistors 302 and 304 form the input differential pair. Current source 306 sets the tail current of the input differential pair and defines the transconductance of the input stage, as shown below:

$$g_{m302,304}=I_{306}/(2*V_T) \quad (6)$$

In expression (6), parameter $V_T$ represents the thermal voltage. Cascode transistors 312 and 314 together with current sources 308 and 310, transfer the transconductance of the input stage of the cascode to the output stage of the cascode where the current mirror formed by transistors 316 and 318 converts the differential signals to a single-ended signal. The output impedance of the cascode at the drain terminals of transistors 314 and 318 is large compared to the resistance of resistor 320. Similarly, the input impedance of the NPN transistor 324 is large compared to the resistance of resistor 320. Resistor 320 is thus used to set the output impedance at the output of the cascode. The voltage gain of the amplifier 102 is defined by the following expression:

$$A_{LGHBA}=g_{m302,304}*R_{320} \quad (7)$$

For example, when $g_{m302,304}$=200 μA/V, and $R_{320}$=100 k Ω, $A_{LGHBA}$ is 20. NPN transistor 324, biased by current source $I_{322}$, is used as an emitter follower to buffer the output of the cascode. PNP transistor 326 level shifts the output signal to a voltage level more suitable for driving the gate terminal of output pass-transistor, and provides further buffering. PNP 326 is biased by current source 136 which supplies a substantially constant bias current $I_{CB}$. The output resistance of closed-loop amplifier 102 is defined by the small signal output impedance of transistor 326 and may be written as shown below:

$$r_O=V_T/I_{CB} \quad (8)$$

Referring back to FIG. 2, output resistance $r_O$ and input capacitance $C_{IN}$ of the output pass-transistor 106 contribute a pole at $f_{P2}=1/(2*\pi*r_O*C_{IN})$ to the frequency response of LDO regulator 100. For a stable operation, it is desirable to move this pole further away from the unity-gain bandwidth $f_0$ of the LDO regulator 100 to avoid the deterioration of the phase margin. Frequency $f_0$ is defined by the output impedance $r_{OUT_LDO}$ of LDO regulator 100 as seen by terminal 122, and by output capacitance $C_{OUT}$. As $r_{OUT_LDO}$ decreases with increasing load current, $f_0$ also increases. The current level of the constant bias current source $I_{CB}$ is kept sufficiently high, so that $f_{P2}$ is always higher than the highest possible value of $f_0$.

Figure 5:
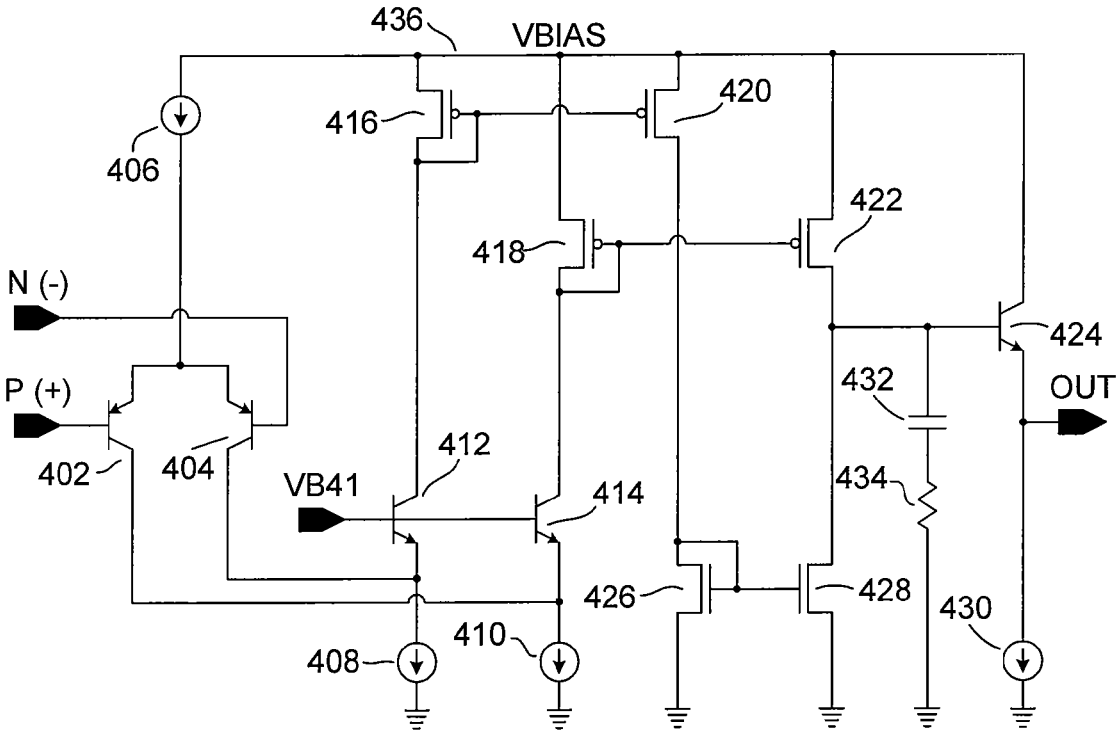
FIG. 5 is a schematic diagram of an exemplary high-gain low-bandwidth amplifier disposed in the LDO voltage regulator of FIG. 2, in accordance with one embodiment of the present invention.

FIG. 5 is a transistor schematic of amplifier 102 of FIG. 2, according to one embodiment of the invention. Amplifier 102 is shown as including a folded cascode input amplification stage, and a full-swing conversion stage buffered by a voltage follower output stage. Bias voltages VB4 may be generated using any one of a number of conventional design techniques. PNP transistors 402 and 404 form the input differential pair. The current source 406 sets the tail current of the input differential pair and defines the transconductance of the input stage, as shown in the expression below:

$$g_{m402,404}=I_{406}/(2*V_T) \quad (9)$$

In expression (9), $V_T$ is the thermal voltage. Cascode transistors 412 and 414, together with current sources 408 and 410, transfer the transconductance of the input stage of the cascode to the output stage of the cascode. The current mirrors formed by PMOS transistor pairs 416/420 and 418/422 further transfer the transconductance of the input stage to the current mirror formed by NMOS transistors 426 and 428; this current mirror converts the differential signal to a single-ended rail-to-rail signal. The transconductance of the input stage and the output impedance of the differential to single-ended converter at the drains of transistors 422 and 428, which is the parallel equivalent of their output impedances $r_{OUT422}$ and $r_{OUT428}$, in parallel with the input impedance of emitter follower transistor 424 defines the gain of the amplifier 102, as shown below:

$$A_{HGLBA}=g_{m402,404}*r_{OUT422}//r_{OUT428}//r_{IN424} \quad (10)$$

Since the output impedances of transistors 422 and 428, and the input impedance of NPN 424 have relatively high values, the DC gain of amplifier 102 is relatively high. For example, in one embodiment, when $g_{m402,404}$=40 μA/V, and $r_{OUT422}//r_{OUT428}//r_{IN424}$=10 M Ω, $A_{HGLBA}$ is 400. NPN transistor 424 provides buffering of the high impedance output node of the differential-to-single ended converter stage and is biased by current source 430. Capacitor 432 and resistor 434 perform a frequency shaping function by providing a pole and zero pair of the loop transfer function.

Figure 6:
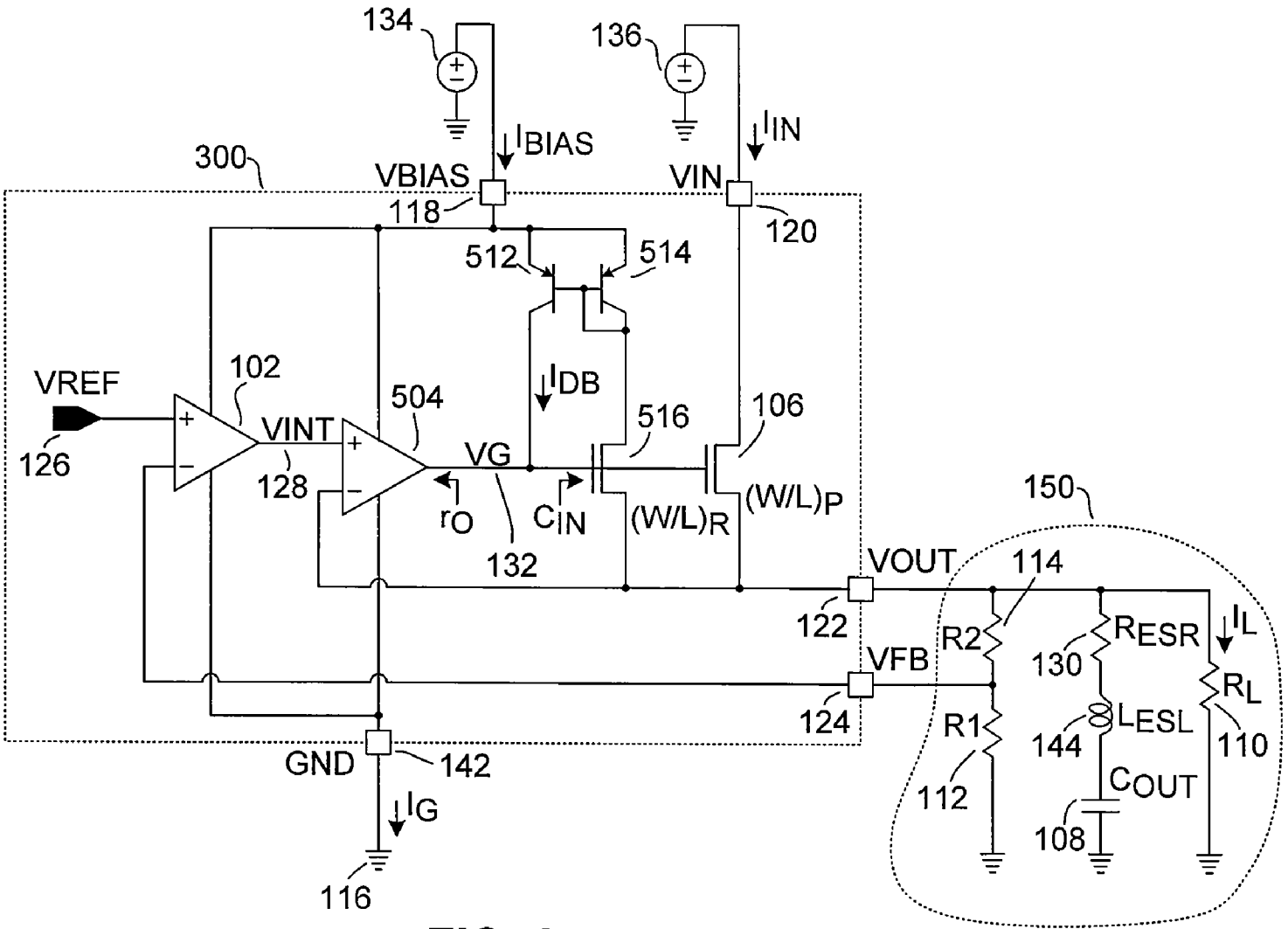
FIG. 6 is a block diagram of an LDO voltage regulator, in accordance with another embodiment of the present invention.

FIG. 6 is a block diagram of an LDO regulator circuit 300, in accordance with another embodiment of the present invention. LDO regulator 300 is similar to LDO regulator 100 of FIG. 2, except that LDO regulator 300 uses a dynamic biasing scheme in place of the constant biasing scheme provided by current source 136 of LDO regulator 100. NMOS transistor 516 is a replica of output transistor 106 and is selected to have a channel-width to channel-length ratio $(W/L)_R$ that is proportional to the channel-width to channel-length ratio $(W/L)_P$ of output pass-transistor 106. Transistor 516's gate and source terminals are connected respectively with the transistor 106's gate and source terminals.

As is well known, the drain current of an MOS transistor is nearly independent of the drain-to-source voltage of the transistor when the transistor operates in the saturation region. This principle is used by the replica transistor 516 to generate a current which is proportional to the current carried by transistor 106. The drain current of transistor 516 is mirrored by the current mirror that includes PNP transistors 512 and 514. The mirrored current $I_{DB}$ flows to gate terminal of transistor 516 at node 132 and biases the output stage of amplifier 504. Assuming the current mirror formed by transistors 512 and 514 has a 1:1 mirroring ratio, the level of current $I_{DB}$ is defined by the input current $I_{IN}$ and the ratio of $(W/L)_R$ to $(W/L)_P$, as shown in the following expression:

$$I_{DB}=I_{IN}*(W/L)_R/(W/L)_P \quad (11)$$

The load current $I_L$ flowing through load resistor 110 is the sum of the input and dynamic bias currents, in accordance with the following expression:

$$I_L=I_{DB}+I_{IN} \quad (12)$$

Often the ratio $(W/L)_P/(W/L)_L$ is selected to be very high, e.g., 1000, thus the load current $I_L$ nearly equals the input current $I_{IN}$.

Figure 7:
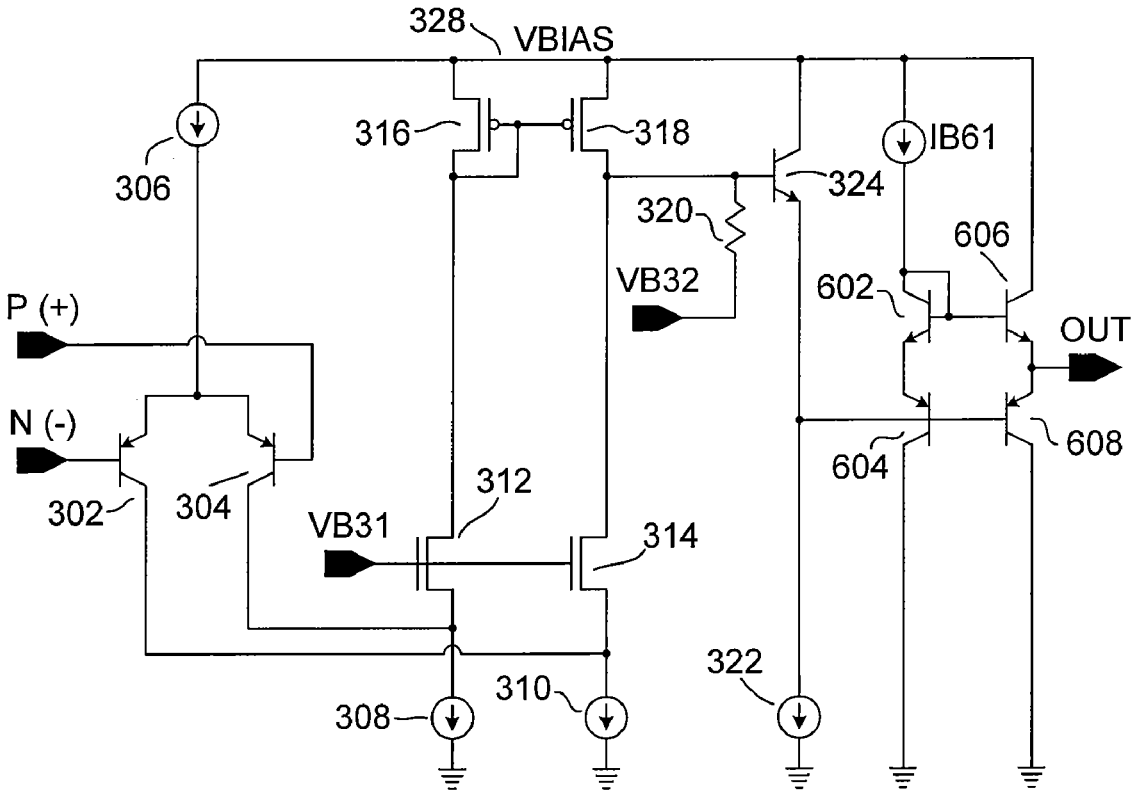
FIG. 7 is a schematic diagram of an exemplary low-gain high-bandwidth amplifier disposed in the LDO voltage regulator of FIG. 6, in accordance with one embodiment of the present invention.

FIG. 7 is a transistor schematic diagram of amplifier 504 of FIG. 6, according to one embodiment of the invention. Amplifier 504 is similar to amplifier the 104 of FIG. 4 except that amplifier 504 has an output stage that is different from output stage 104 of FIG. 4. The output stage of amplifier 504 includes NPN transistors 602 and 606, PNP transistors 604 and 608 and current source 620 supplying current $I_B$.

Referring concurrently to FIGS. 6, and 7, the output impedance $r_O$ of amplifier 504 of FIG. 7 is defined by the parallel equivalent of the output impedances of bipolar transistors 606 and 608. When the load current $I_L$ is zero, no dynamic biasing current is sourced into the gate node 132. Neglecting the base currents, the output stage transistors 602, 604, 606 and 608 have emitter currents that are equal to the current supplied by current source 620; this sets the output impedance for transistors 606 and 608 at $V_T/I_B$. This output impedance $r_O$, together with the input capacitance $C_{IN}$ of the output pass-transistor 106 contribute a pole at $f_{P2}=1/(2*\pi*r_O*C_{IN})$ to the frequency response of the LDO regulator 300. Current $I_B$ is selected such that it sets the output impedance of amplifier 504 to a low enough value so as to guarantee that $f_{P2}$ is always sufficiently higher than $f_0$ at zero or very low load currents. At higher load currents, the dynamic biasing circuit, as described above, causes the bias current $I_{DB}$ to increase, thus increasing the emitter current of PNP 608, which in turn decreases the output impedance of the amplifier 504 in proportion with the load current. The unity gain frequency $f_0$ of the LDO regulator 300 moves to higher frequencies with increasing load current, and dynamic biasing circuit keep $f_{P2}$ higher than $f_0$ as the load current changes.

Figure 8A:
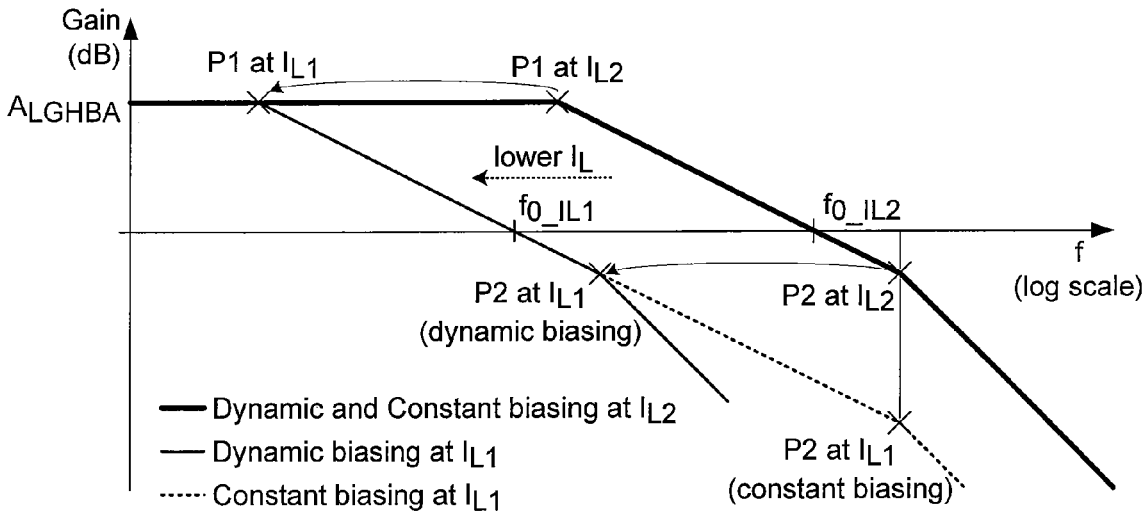
FIG. 8A shows the frequency responses of the closed-loop low-gain high-bandwidth amplifiers of FIGS. 2 and 6.

FIG. 8A illustrates the relationship between the load current and pole locations for both constant biasing scheme used in FIG. 2, and dynamic biasing scheme used in FIG. 6. FIG. 8A only takes into account the poles associated with amplifiers 104/504, load resistance $R_L$ and output capacitor $C_{OUT}$. The contribution of amplifier 102 to the overall frequency behavior of the LDO regulators 100 and 300 is not shown in this Figure as it is independent of load current. It is understood that the overall frequency response of LDO regulators 100/300 may be obtained by simply adding the pole-zero pair of amplifier 102 to the frequency characteristics shown in FIG. 8A.

Pole P1 is determined by $r_{OUT_LDO}$ and $C_{OUT}$ and is a function of the load current $I_L$ since both load resistance and the output impedance of the LDO regulators are tied to the load current. The location of pole P1 is shown for two different values of load currents $I_{L1}$ and $I_{L2}$. Pole P2 is contributed by the output impedance $r_O$ of amplifiers 104/504 and the input capacitance $C_{IN}$ of pass-transistor 106. At current level $I_{L2}$, the location of P2 is the same for both constant and dynamic biasing schemes, shown as point 700, and is set to be higher than the unity gain frequency $f_{0_IL2}$ for stability. As the load current decreases to a lower level $I_{L1}$, the dynamic biasing scheme moves the pole P2 to new point 702 while keeping it higher than the new unity gain frequency $f_{0_IL1}$. However the pole P2 associated with the constant biasing scheme is maintained at substantially the same frequency. The new position of pole P2 for the constant biasing scheme and associated with the smaller load current level $I_{L1}$ is shown at point 704.

Figure 8B:
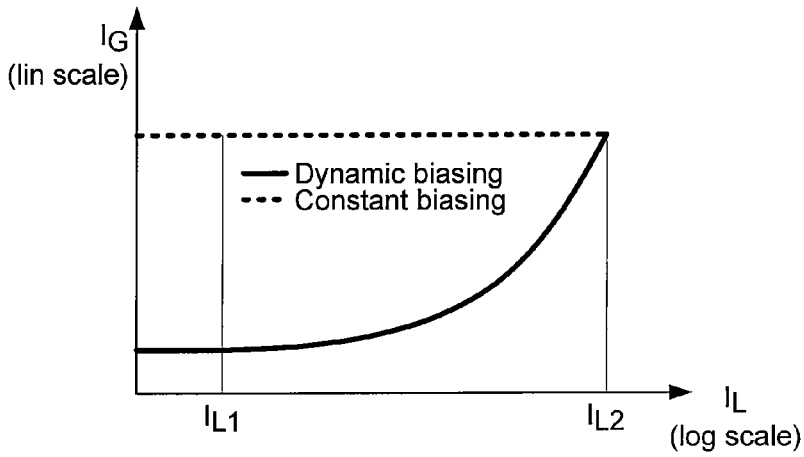
FIG. 8B shows the quiescent ground currents of LDO voltage regulators shown in FIGS. 2 and 6.

FIG. 8B shows the ground current $I_G$ associated with LDO regulators 100 and 300, shown respectively in FIGS. 2 and 6. The dynamic biasing scheme of LDO regulator 300 keeps the ground current proportional to the output current, as shown in plot 720, to improve the efficiency of the LDO regulator at lower output currents. The constant biasing scheme keeps the ground current constant as the load current varies as shown in plot 740.

LDO regulators 100 and 300 are adapted to source current, accordingly a sudden removal of a high load current causes a voltage overshoot at the output of such regulators. The cause of the overshoot is the response time $T_{DG}$ of the control loop while trying to throttle back the current through the pass-transistor 106. When the load is suddenly removed, the pass-transistor stays on for the duration of the response time and keeps supplying excessive charge onto the output capacitor. When the loop regains control, there is no pull-down current available at the output and it takes a finite amount of time for the LDO regulator to recover from this overshoot condition.

Figure 10:
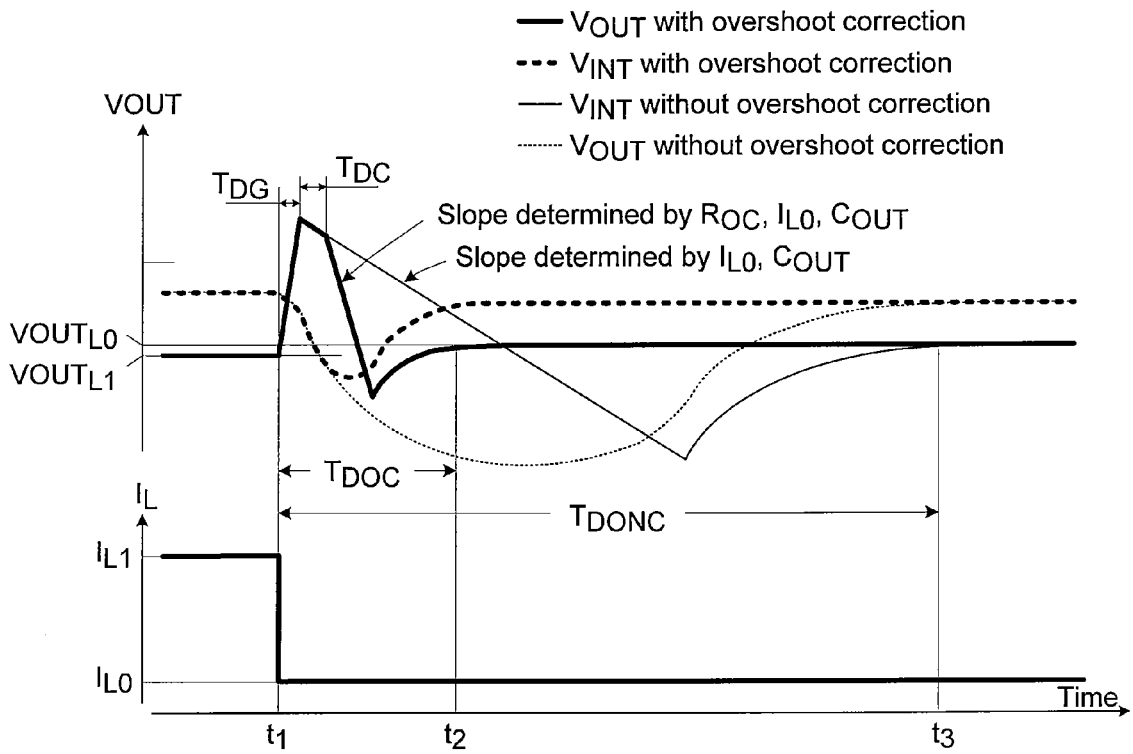
FIG. 10 shows the time variations of the output voltages of LDO regulators of FIGS. 3, 6 and 9, in accordance with one embodiment of the present invention.

Referring to FIG. 10, traces 905 and 910 respectively show the time variations of output voltage VOUT and input voltage VINT for regulators 100 and 300. The recovery time is shown as $T_{DONC}$.

Figure 9:
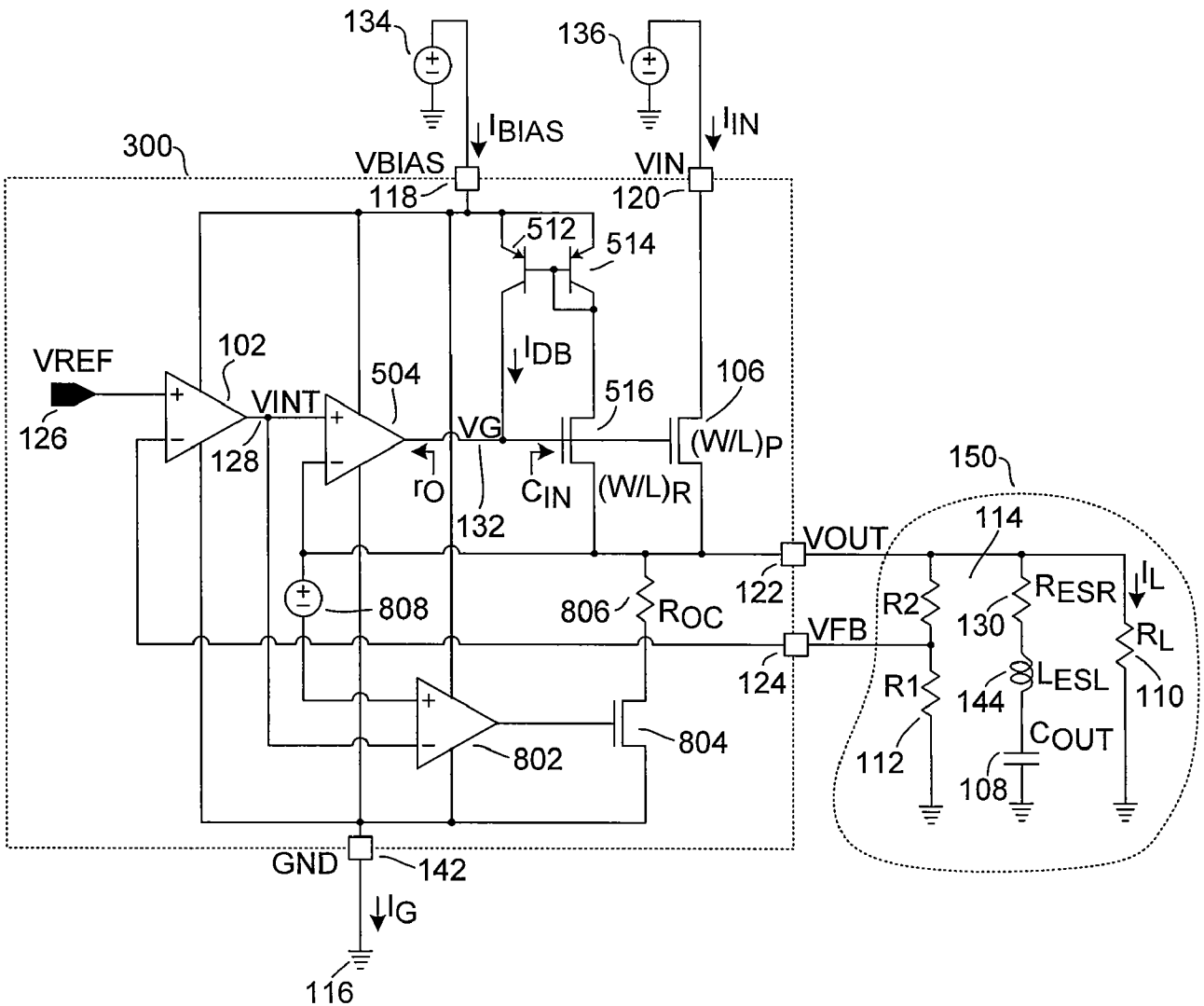
FIG. 9 is a block diagram of an LDO voltage regulator, in accordance with another embodiment of the present invention.

FIG. 9 shows an LDO regulator 800 with dynamic biasing and overshoot correction circuit, in accordance with another embodiment of the invention. The overshoot correction circuit includes comparator 802, NMOS pull down transistor 804, pulldown resistor 806 (having resistance ($R_{OC}$) and an optional offset voltage source 808. Assume that the voltage supplied by offset voltage source 808 is zero. The relatively low gain of amplifier 104 and the positive non-zero gate-to-source voltage of pass-transistor 106 ensure that voltage VINT present at node 128 is higher than output voltage VOUT when LDO regulator 800 is in regulation. When the load current is removed however, the output voltage VOUT overshoots and voltage VINT starts to droop at a rate defined by the bandwidth of amplifier 102 to counter the overshoot. At some point in time VINT goes below VOUT. Comparator 802 is adapted to detect when VINT falls below VOUT, and in response, switches its output state, thereby turning on NMOS transistor 804. When NMOS transistor 804 is turned on, resistor 806 provides a discharge path to ground for the excess charge stored on output capacitor $C_{OUT}$, thus bringing the output voltage VOUT back into regulation in a relatively short time interval.

Traces 915 and 920 of FIG. 10 respectively show the time variations of output voltage VOUT and input voltage VINT for regulator 800. The improved recovery time is shown as $T_{DONC}$. Parameter $T_{DG}$ represents the response time of the feedback loop while trying to throttle the pass-transistor 106's current back and $T_{DC}$ represents the delay of the comparator 802 in sensing the overshoot condition from the respective levels of VINT and VOUT. Offset voltage source 808 may be assigned a non-zero voltage to ensure that VINT is always higher than the voltage applied to the positive input terminal of comparator 802, even in presence of device mismatches, different pass-transistor characteristics and other effects. Comparator 802 may be a conventional comparator.

The above embodiments of the present invention are illustrative and not limiting. Various alternatives and equivalents are possible. The invention is not limited by the type of amplifier, current source, transistor, etc. The invention is not limited by the type of integrated circuit in which the present invention may be disposed. Nor is the invention limited to any specific type of process technology, e.g., CMOS, Bipolar, or BICMOS that may be used to manufacture the present invention. Other additions, subtractions or modifications are obvious in view of the present disclosure and are intended to fall within the scope of the appended claims.

What is claimed is:

1. A voltage regulator circuit comprising:

a first amplifier operative to receive a first reference voltage and a feedback voltage, said first amplifier being biased by a first biasing voltage;

a second amplifier having a first input terminal receiving an output voltage of said first amplifier, and a second input terminal receiving a regulated output voltage of the circuit;

said second amplifier being biased by the first biasing voltage;

an N-type transistor having a first terminal responsive to an output of the second amplifier, a second terminal receiving an input voltage being regulated, and a third terminal supplying the regulated output voltage, wherein said feedback voltage is generating by dividing the regulated output voltage;

a comparator responsive to the output of the first amplifier and to the regulated output voltage; and a controlled discharge circuit responsive to the output of the comparator and adapted to provide a discharge path from the third terminal of the first N-type transistor to ground.

2. The voltage regulator circuit of claim 1 further comprising:

an offset voltage supply disposed between the second amplifier and the comparator.

3. A method of regulating a voltage, the method comprising:

applying a first reference voltage and a feedback voltage to a first amplifier;

applying an output signal of the first amplifier and a regulated output voltage to a second amplifier;

biasing the first and second amplifiers using a first biasing voltage;

applying an output of the second amplifier to a first terminal of an N-type transistor, a second terminal of the N-Type transistor receiving an input voltage being regulated, a third terminal of the N-Type transistor supplying the regulated output voltage;

generating the feedback voltage from the regulated output voltage;

comparing an output voltage of the first amplifier to the regulated output voltage; and providing a discharge path from the third terminal of the first N-type transistor to ground when the output voltage of the first amplifier is detected as being smaller than the regulated output voltage.

4. The method of claim 3 further comprising:

applying an offset voltage between the second amplifier and the comparator.

* * * * *